United States Patent [19]

Gattus

[11] 4,175,489

[45] Nov. 27, 1979

[54] INKING AND WASHING CIRCUIT FOR A FLEXOGRAPHIC PRINTING MACHINE

[75] Inventor: Yves Gattus, Villeurbanne, France

[73] Assignee: S. A. Martin, Villeurbanne, France

[21] Appl. No.: 911,144

[22] Filed: May 31, 1978

[51] Int. Cl.[2] ..... B41F 31/08; B41F 35/04

[52] U.S. Cl. ..... 101/366; 101/425

[58] Field of Search ..... 101/425, 423, 424, 364, 101/363, 366, 153, 207, 208, 210, 148, 340, 344, 347, 350, 355, 356, 360, 315, 321, 326; 15/320, 322, 327 R, 354, 246.5; 118/70, 429, 259, 261; 68/184, 200, 202

[56] References Cited

U.S. PATENT DOCUMENTS

| | | | |
|---|---|---|---|
| 3,611,927 | 10/1971 | Johnson | 101/425 |
| 3,783,782 | 1/1974 | Hardt | 101/153 X |
| 3,974,768 | 8/1976 | Grobman | 101/425 |
| 4,015,453 | 4/1977 | Bryant | 101/425 |

*Primary Examiner*—J. Reed Fisher

*Attorney, Agent, or Firm*—Haseltine, Lake & Waters

[57] ABSTRACT

The inking and washing circuit of a flexographic printing machine includes a device comprising a fixed plate on which an immersion pump assembly is mounted with the pump below the plate, and lifting means for receiving a container of ink or for washing purposes and for lifting the container up to a position against the underside of the plate in which the pump is within the container. Washing nozzle means are mounted on the underside of the plate along a closed shape surrounding the pump assembly, which shape is within the open mouth of the washing container but outside the open mouth of the ink container.

2 Claims, 3 Drawing Figures

FIG 2
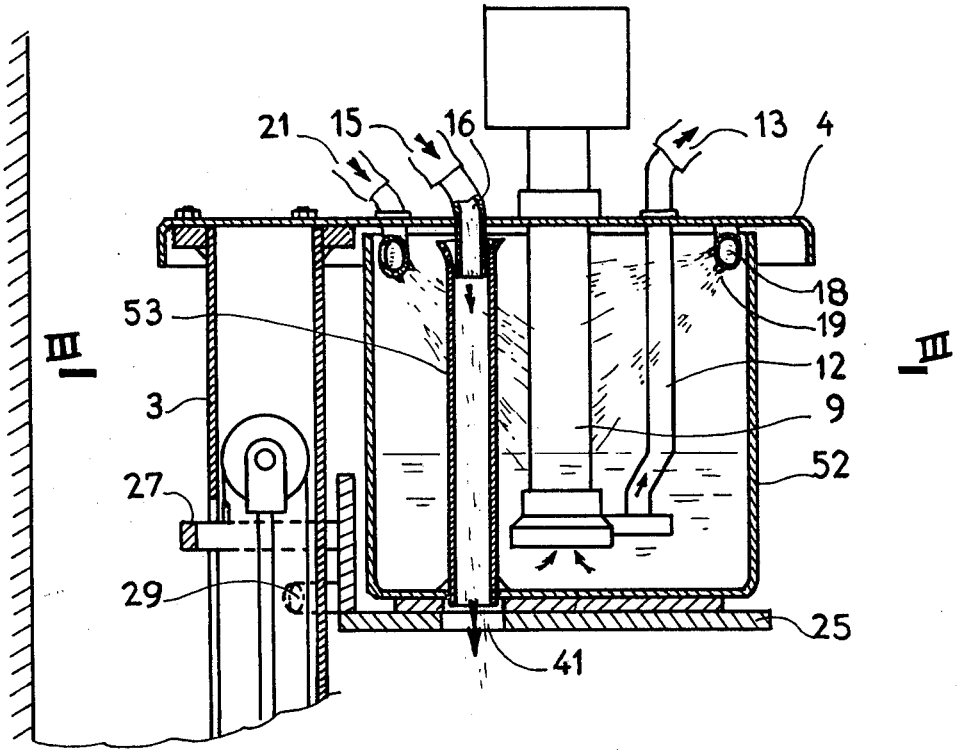
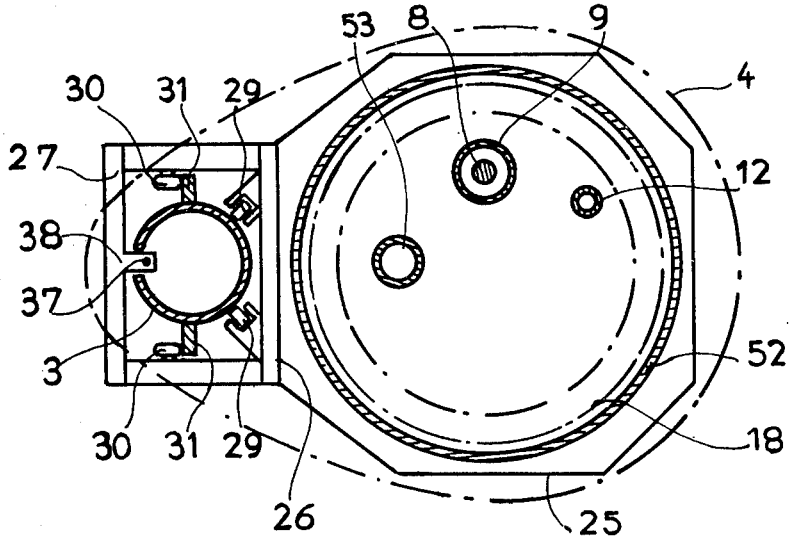
FIG 3

INKING AND WASHING CIRCUIT FOR A FLEXOGRAPHIC PRINTING MACHINE

The present invention relates to an improvement to the inking and washing circuit of a flexographic printing machine, which improvement is particularly but not exclusively applicable to a flexographic printing station on a printer-slotter for finishing corrugated cardboard packaging boxes.

In the manufacture of corrugated cardboard packaging boxes the blank sheets produced by the corrugating machine are subsequently finished by cutting and printing on a machine usually called a printer-slotter. Depending on the nature of the prints produced, the printing stations of these machines are either fatty-ink printing stations or so-called flexographic stations which use inks which are diluted with water and have a very fluid consistency.

In the known flexographic printing units, the ink feed circuit frequently comprises an ink container with a pump for feeding the ink to the inking rollers, and a return circuit to the container, the ink being returned by gravity or by means of a return pump depending on whether the printing station is in a high or low position for printing the sheet from above or from below. When changing the ink, the circuit has to be washed and the washing requires certain operations, for example of filling the container with water or of discharging the return circuits to waste, which complicates the washing operation and extends its duration.

Sometimes, the ink container is also used directly as a reservoir, by providing it with a lid equipped with a centrifugal immersion pump, which has the advantage of stirring the ink to prevent its sedimentation, above all if the pump is equipped with an auxiliary stirring nozzle. However, in this case it is necessary to handle the entire pump and its delivery tubes each time the ink container is changed. For washing, one or more containers full of water have to be substituted for the ink container. The washing operations are thus still laborious and long and therefore expensive.

According to the invention there is provided an inking and washing device for use in the inking and washing circuit of a flexographic printing machine which circiut comprises a feed pump assembly of the immersion type, said feed pump assembly comprising a feed pump for drawing ink from a reservoir and a delivery tube, and a drive motor for driving said pump, a circuit for feeding ink from said pump delivery tube to inking rollers, and a circuit for returning ink to the reservoir, said inking and washing device comprising:

a fixed horizontal plate which is mounted on the framework of the printing machine and supports said feed pump assembly with said drive motor above said plate, said pump below said plate and said delivery tube passing through said plate and fixedly connected above said plate to said ink feed circuit, a fixed ink return tube which passes through said plate and is fixedly connected above said plate to said ink return circuit, washing nozzle means fixed underneath said plate and along a closed shape which surrounds the components of said pump assembly and said ink return tube, said nozzle means being fixedly connected to a water-feed circuit, at least one container for forming an ink reservoir and having a top opening which fits inside said closed shape but surrounds the components of said pump assembly and said ink return tube, at least one washing container having a top opening which fits outside said closed shape and includes an overflow connectable to waste, and lifting means for selectively receiving one of said ink reservoir containers and said washing container, and for moving said containers under said plate between a high position in which its upper edge is adjacent said plate and a low position in which its upper edge lies below said pump.

Preferably said overflow of said washing container includes a bypass tube which passes through the wall of said container and is arranged so that in said high position of said container it connects directly to said ink return tube.

The invention will be more fully understood from the following description of an embodiment thereof, given by way of example only, with reference to the accompanying drawings.

In the drawings:

FIG. 2 is a partial view similar to that of FIG. 1, of the device of FIG. 1 in the washing position; and FIG. 3 is a section on the line III—III of FIG. 2, intended to show more particularly the guiding of the lifting means of the device of FIG. 1.

Figure 1:
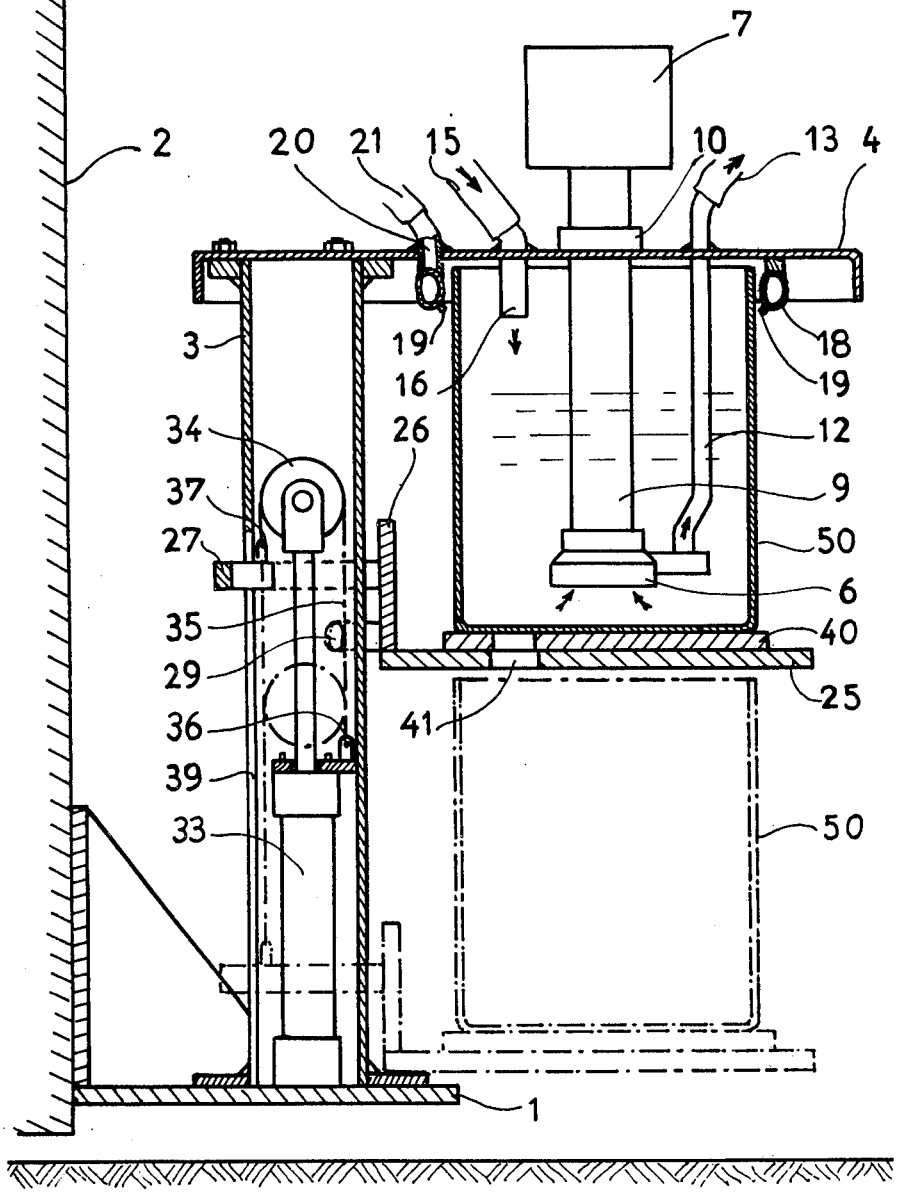
FIG. 1 is a general assembly view, in axial section, of an embodiment of a device according to the invention in the inking position.

Referring to the drawings, it will be seen that the device is carried by a bracket 1 firmly fixed to the side frame 2 of a printing machine. The bracket supports a tubular vertical column 3, which is in turn covered by a horizontal plate 4 which extends beyond the column 3 by a substantial amount in the direction away from the printing machine.

The plate 4 supports a conventional feed pump assembly which is of the immersed centrifugal type and comprises a pump 6 which is connected to a drive motor unit 7 by a shaft 8 (FIG. 3) which is protected by a spacer column 9. The column 9 passes through the plate 4, to which it is fixed by a collar 10 in such a way that the pump 6 is located below the plate whilst the motor unit 7 is located above it. The pump delivery line 12 also passes through the plate and is connected, above the plate, to a tube 13 which leads to the general inking circuit of the printing machine.

The ink return circuit of the printing machine, which returns the excess ink to the reservoir so that it can be recycled, is here simply represented by the end of a return tube 15. The tube 15 comes directly from the inking circuits if the printing machine is a high printing machine which allows return to the reservoir to take place simply by gravity. If the printing machine is low, for example for printing the cardboard sheets from below, the tube 15 is connected to a return pump. The tube 15 is connected to a short nozzle 16 which passes through the plate 4 to which it is fixed.

The lower face of the plate 4 is additionally equipped with a fixed circular manifold 18 provided with spray nozzles 19 spaced apart along the manifold 18. The manifold 18 is connected by a fixed line 20, which passes through the plate 4, to a tube 21 which is itself connected to a feed circuit for tapwater under pressure, by means of a simple tap or an electromagnetic valve.

The column 3 serves as a guide for the vertical movement of a square lifting device comprising a horizontal plate 25 and a vertical part 26 firmly fixed to a frame 27 which surrounds the column. The whole of the lifting device bears against the column by means of rollers 29 and counter-pressure is provided by rollers 30 which act on the rear faces of the vertical fins 31 on the column. The vertical movement of the lifting device is provided by a jack 33 fixed to the bracket 1 and located inside the column, the head of the rod of the jack acting on an idling guide wheel 34. A cable 35, which is fixed at 36 to a member which is firmly attached to the jack 33 and to the column 3, passes over the wheel 34 and is fixed at 37 to an extension 38 of the frame 27, which extends into the column through a slot 39. It will be seen that any movement of the piston rod results in a movement, of twice the amplitude, of the lifting system and in particular of the horizontal plate 25. FIG. 1 shows, respectively in solid lines and in dot-dash lines, the two extreme positions of the plate 25, the low position being very slightly above the floor. In the low position of the plate 25, containers which will be referred to later can pass freely under the lowest point of the pump 6.

The plate 25 is equipped with a centering wedge 40, and the combination is provided with an orifice 41 coaxial with the vertical axis of the nozzle 16.

In order to use the ink feed device, that is to say for normal functioning of the printing machine, an ink container 50 is placed on the centering wedge 40 of the plate 25 when the plate is in its low position. The controls of the jack 33 are then operated to lift the plate 25 and bring it into the position shown in FIG. 1. It will be seen there that the diameter of the manifold 18 is so chosen that a standard ink container 50 fits inside this collar. When the device is in the position shown in FIG. 1, ink drawn up by the pump 6 is delivered by the tube 12 to the inking circuit 13. The return flow of ink to the container passes through the tube 15 and the nozzle 16 and hence falls directly into the container. The immersed pump, by itself, provides stirring of the ink by a vortical movement, which stirring is further improved by an auxiliary attachment which delivers into the container a weak jet of ink taken off the delivery circuit.

In order to wash the circuits when changing the ink, in which case the printing machine is out of operation, the plate 25 is lowered and the ink container 50 is removed and replaced by a special washing container 52 shown in FIG. 2. This washing container 52 has a larger diameter than the standard ink container, so that, when it is in the position shown in FIG. 2, the manifold 18 and the washing nozzles 19 are located inside the container 52. Furthermore, the container 52 possesses a vertical tube 53 of the same height as the container, but flared at its upper end, and passing through the bottom of the container 52. When the container 52 is in position on the centering wedge 40, the lower end of the tube 53, which projects slightly beyond the bottom of the container 52, extends into the orifice 41 in the plate. In the high position shown in FIG. 1 the flared upper end of the tube 53 surrounds the fixed tube 16. To carry out the washing operation, water is fed to the tube 21 and to the circular manifold 18, which thus sprays, by means of its nozzles 19, jets of clean water onto the column 9 of the pump, which has been soiled during its preceding immersion in the ink, as well as onto the delivery tube 12. The sprayed water accumulates in the bottom of the container 52 from where it is taken up by the pump 6 and delivered through the normal inking circuit to the inking rollers. It returns from there through the return tube 15 but it will be seen that the return water does not return to the washing container but goes directly to waste through the tube 53. A continuous circulation of clean water is thus achieved, with the dirty water not being recycled. When sufficient has been circulated to wash the whole, and when the return water is clear, the plate 25 can again be lowered and the washing container replaced by a fresh container of ink. It will be seen that, throughout these operations, handling has been restricted to the minimum. Only the ink containers are handled whilst full, and even this handling is restricted to placing the container on the very low platform 25. For washing, no handling of a container full of water is involved, the container 52 being empty when handled.

Of course the invention is not strictly limited to the embodiment which has been described by way of example only but also embraces embodiments which only differ therefrom in details, in variations in execution, or in the use of equivalent means. Thus, the continuous manifold 18 may be replaced by a plurality of separate spray nozzles, and the device for distributing water to all these nozzles can be located above the plate 4. It is merely necessary to arrange the manifold 18, or the separate nozzles which replace the manifold, along a closed shape which is outside the standard ink containers but inside the special washing container. This arrangement thus makes it possible to prevent an error in operation in which water is delivered at the wrong time into an ink container, and also makes it possible to wash the outside of an ink container if the latter has been soiled during handling.

There is thus provided a device whereby it is possible both to provide ink feed under better stirring conditions, and hence better conditions of homogeneity of the ink, and at the same time to restrict to the minimum the handling of the containers.

What is claimed is:

1. An inking and washing device for use in the inking and washing circuit of a flexographic printing machine which circuit comprises a feed pump assembly of the immersion type, said feed pump assembly comprising a feed pump for drawing ink from a reservoir and having a delivery tube, and a drive motor for driving said pump, a circuit for feeding ink from said pump delivery tube to inking rollers, and a circuit for returning ink to the reservoir, said inking and washing device comprising: a fixed horizontal plate; means for mounting said plate on the framework of the printing machine; means supporting said feed pump assembly on said plate with said drive motor above said plate, said pump below said plate and said delivery tube passing through said plate; means fixedly connecting said delivery tube above said plate to said ink feed circuit; a fixed ink return tube which passes through said plate; means fixedly connecting said return tube above said plate to said ink return circuit; washing nozzle means fixed underneath said plate and above a closed shape which surrounds the components of said pump assembly and said ink return tube; means fixedly connecting said washing nozzle means to a water-feed circuit; at least one container for forming an ink reservoir and having a top opening which fits inside said closed shape but surrounds the components of said pump assembly and said ink return tube; at least one washing container having a top opening which fits outside said closed shape and includes an overflow connectable to waste; and lifting means for selectively receiving one of said ink reservoir container or one of said washing container, and for moving said one selectively received container under said plate between a high position in which its upper edge is adjacent said plate and low position in which its upper edge lies below said pump.

2. A device according to claim 1, wherein said overflow of said washing container comprises a bypass tube passing through the wall of said washing container and arranged so that in said high position of said washing container said bypass tube connects directly to said ink return tube.

* * * * *